US009766010B2

(12) United States Patent
Katu et al.

(10) Patent No.: US 9,766,010 B2
(45) Date of Patent: Sep. 19, 2017

(54) LIGHTING FOR SHELF DIVIDER IN REFRIGERATOR

(71) Applicant: Whirlpool Corporation, Benton Harbor, MI (US)

(72) Inventors: Umakant Suresh Katu, Pune (IN); Basavraj Ishwar Sankhgond, Evansville, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 132 days.

(21) Appl. No.: 13/873,279

(22) Filed: Apr. 30, 2013

(65) Prior Publication Data

US 2014/0320040 A1 Oct. 30, 2014

(51) Int. Cl.

| | |
|---|---|
| ***F21V 33/00*** | (2006.01) |
| ***F25D 27/00*** | (2006.01) |
| ***H05B 33/08*** | (2006.01) |
| *F25D 23/06* | (2006.01) |
| *F25D 25/02* | (2006.01) |

(52) U.S. Cl.

CPC ..... *F25D 27/00* (2013.01); *H05B 33/0863* (2013.01); *F25D 23/069* (2013.01); *F25D 25/02* (2013.01); *F25D 25/025* (2013.01); *F25D 2400/40* (2013.01)

(58) Field of Classification Search

CPC ..... F25D 27/00; F25D 27/005
USPC ..... 362/92
See application file for complete search history.

(56) References Cited

U.S. PATENT DOCUMENTS

| | | | | |
|---|---|---|---|---|
| 3,506,325 | A | 4/1970 | Horvay | |
| 5,034,861 | A | 7/1991 | Sklenak et al. | |
| 5,287,252 | A | 2/1994 | Caruso | |
| 6,042,244 | A * | 3/2000 | Witkoski | 362/133 |
| 6,231,205 | B1 | 5/2001 | Slesinger et al. | |
| 7,338,180 | B2 | 3/2008 | Wing | |
| 7,559,672 | B1 * | 7/2009 | Parkyn et al. | 362/244 |
| 7,857,473 | B2 * | 12/2010 | Shibusawa et al. | 362/92 |
| 7,905,614 | B2 * | 3/2011 | Aoki | 362/92 |
| 8,322,873 | B2 | 12/2012 | Glovatsky et al. | |
| 2003/0137828 | A1 * | 7/2003 | Ter-Hovhannisian | 362/92 |

(Continued)

FOREIGN PATENT DOCUMENTS

| | | |
|---|---|---|
| CN | 201672763 | 12/2010 |
| CN | 201870219 | 6/2011 |

(Continued)

OTHER PUBLICATIONS

European Patent Application No. 14162092.2 filed Mar. 27, 2014, Applicant: Whirlpool Corporation, European extended search report, mail date Mar. 25, 2015 re: same.

*Primary Examiner* — Bryon T Gyllstrom

(57) ABSTRACT

An apparatus, system and method for illuminating the interior of a refrigerated appliance such as refrigerator, freezer or combination includes storage shelf or surface in the appliance, a divider positioned relative at shelf or storage surface, and a divider lighting subassembly on the divider. Electrical power is provided from an electrical power source in the appliance to the divider lighting subassembly on the divider. Light sources of the divided light subassembly can be selected to illuminate from a position on the divider. Different lighting schemes can be instructed to the light sources. The light sources can be LEDs.

30 Claims, 12 Drawing Sheets

(56) References Cited

U.S. PATENT DOCUMENTS

| | | | | |
|---|---|---|---|---|
| 2004/0062031 | A1* | 4/2004 | Pinter | 362/31 |
| 2004/0264160 | A1* | 12/2004 | Bienick | 362/31 |
| 2005/0265019 | A1* | 12/2005 | Sommers et al. | 362/217 |
| 2007/0171647 | A1* | 7/2007 | Artwohl et al. | 362/276 |
| 2007/0223226 | A1* | 9/2007 | Park | 362/267 |
| 2008/0007945 | A1* | 1/2008 | Kelly et al. | 362/218 |
| 2008/0163641 | A1* | 7/2008 | Mitchell | 62/389 |
| 2008/0236183 | A1* | 10/2008 | Iimura | 62/264 |
| 2010/0170279 | A1 | 7/2010 | Aoki | |
| 2010/0290251 | A1* | 11/2010 | Wang et al. | 362/612 |
| 2011/0164399 | A1 | 7/2011 | Driver | |
| 2012/0043338 | A1 | 2/2012 | Yang et al. | |

FOREIGN PATENT DOCUMENTS

| | | | |
|---|---|---|---|
| CN | 202216484 | | 5/2012 |
| FR | 2946852 | B1 | 12/2010 |
| GB | 2255820 | | 11/1992 |
| JP | 201324509 | A | 2/2013 |
| KR | 20110034271 | | 4/2011 |
| WO | 2008026913 | A1 | 3/2008 |
| WO | 2010015332 | | 2/2010 |
| WO | 2012021807 | | 2/2012 |

* cited by examiner

LIGHTING FOR SHELF DIVIDER IN REFRIGERATOR

FIELD OF THE INVENTION

The present invention relates to refrigerated devices such as refrigerators, freezers or refrigerators/freezers, and in particular, to illumination inside such appliances.

BACKGROUND OF THE INVENTION

A variety of lighting/illumination schemes exist for refrigerated appliances. Because the refrigerated spaces are substantially enclosed, illumination is needed to allow the user to visually identify the contents of those spaces.

One conventional illumination system is an incandescent bulb that can be removably replaced in a socket that is hardwired to an electrical power source. The bulb is positioned to distribute light to at least a substantial part of at least one compartment of the appliance. For example, sometimes a single incandescent bulb illuminates an entire fresh food or freezer compartment. But at the same time, because the bulb is connected to electrical power, a variety of temperature ranges might be experienced by the bulb, and there can be liquids and other substances that could detrimentally affect the bulb or its illumination. Frequently the bulb is placed under some protective but at least partially light transmissive cover. Sometimes the bulb is recessed into a side wall of the liner. It is, of course, beneficial to minimize occupation of otherwise useable storage space in the appliance. But on the other hand, the light source must have some method to distribute light in the compartment and thus cannot be substantially blocked. Furthermore, minimization of the number of light sources, sockets, etc. can be desirable to minimize cost, complexity, and power use in the appliance. A further complication is that incandescent lamps have limited life spans. Most times an access door or removable cover is required for easy replacement.

A simple way to operate such lights is to automatically switch them on when the refrigerator door is open and turn them off when the door is closed. In more modern appliances, a programmable microprocessor or controller can be involved. It can monitor state or status of the appliance (e.g., whether the door is open or closed) and issue instructions regarding turning illumination on or off, adjusting cooling, etc.

It can therefore be appreciated, and is well-known in the technical field, that there are competing factors regarding illumination of the interior of a refrigerated appliance. As indicated above, these factors not only can include matters specific to lighting but also to refrigeration. Still further, they can relate to cost, complexity, and functionality. Still further, they can relate to consumer demand regarding the features. They can even relate to aesthetics related to this apparatus.

Refrigerated appliances have, as a primary function, the refrigerated storage of perishable food items. Towards that end, designers in this technical field also continuously work towards functionality and flexibility of that storage space. For example, the typical household refrigerated appliance has a fresh food compartment and a freezer compartment. Each of those compartments can be further physically subdivided. Examples include plural shelves, drawers, bins, baskets, or sub-compartments. Furthermore, each of those storage options can be further subdivided.

One example would be a divider for a shelf. The shelf has generally a flat supporting surface. A shelf divider is many times an available option. It could either be fixed to the shelf or movable relative to the supporting surface of the shelf. It would partition the supporting surface of the shelf. It typically is basically a plate, wall, or other member that spans all or some of the front-to-back depth (or possibly the side to side width) of a shelf or drawer. They are typically inexpensive, lightweight, and thin. They take up minimum space but physically divide a space. Analogous dividers could also be used relative to other supporting surfaces that essentially are shelves but in the context of a floor in a drawer, bin, or basket.

Again, there are competing interests regarding such dividers in subpartitioning of such supporting surfaces. It can be desirable that such a divider be made of lightweight material and as thin as possible to minimize the amount of usable storage space that is taken up, which again is the primary function of the appliance. It can also many times be desirable that it be adjustable so that a user can customize how that supporting surface or shelf surface is partitioned.

It can therefore be appreciated that such dividers also present competing factors to the divider designer.

It is in this context that it has been discovered there remains room for improvement regarding illumination of the interior of refrigerated appliances. Competition for internal storage space, flexibility of storage space and its configuration, as well as sufficient illumination are but a few.

SUMMARY OF THE INVENTION

It is therefore a principle object, feature, aspect or advantage of the present invention to improve over or solve problems and deficiencies in the state of the art.

Further objects, features, advantages or aspects of the present invention include an illumination system associated with a divider for a shelf or other supporting surface which:

a. balances competing factors regarding storage space and illumination;
b. promotes good efficacy and efficiency of illumination;
c. promotes flexibility and efficiency of configuration of storage space while providing electrical power for and mounting of illumination sources on a divider;
d. provides flexibility in illumination schemes;
e. can be used for specific lighting or illumination tasks inside the appliance to supplement other lighting, or can be a primary illumination source for at least a compartment of the appliance.

In one aspect of the invention, a refrigerator shelf surface for the interior of a refrigerator cabinet includes a supporting surface having top, bottom and opposite sides, a divider member positioned along the top to physically separate portions of the supporting surface, a light source subassembly mounted in, on or at the divider, and an electrical connection from the light source subassembly to an electrical power source connection in the cabinet.

In another aspect of the invention, the divider is movable along the supporting surface, and includes one or more sets of LED light sources. Electrical power can be through hard wiring or a temporary connection.

In another aspect, the divider is fixed to the cabinet or liner for a compartment of the cabinet.

In another aspect, the divider is mounted on a movable shelf and moves with the movable shelf.

In another aspect of the invention, one or more light source subassemblies is mounted in a housing which can, in turn, be mounted on a divider. The housing can optionally include an optical component that is removable mountable over the light sources to alter the light output pattern from the light sources.

In another aspect of the invention, lighting mounting on a divider can be operated according to different lighting schemes. The lighting schemes can be related to either color of output, on/off instigation, output intensity over time, or other presentations.

In another aspect, the divider lighting can be used alone to illuminate at least a portion of the interior of the appliance or it can be used in combination with other illumination sources.

DETAILED DESCRIPTION OF EXEMPLARY EMBODIMENTS

A. Overview

For a better understanding of the invention, several examples of forms the invention might take will be described in detail. It is to be understood these are but a few examples of the invention and neither inclusive or exclusive.

Figure 9A:
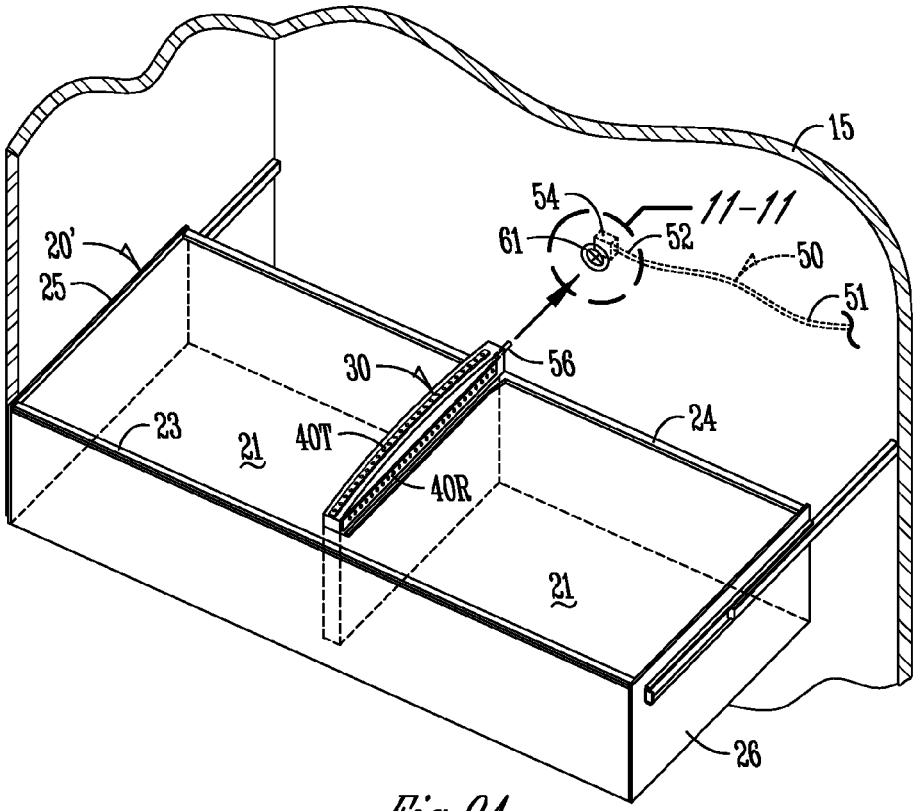
FIGS. 9A-B are perspective views of an alternative embodiment according to the present invention where the shelf divider is in the context of a bin or drawer that is slidable forwardly (FIG. 9A) from a home position (FIG. 9B) and the divider is fixed or mounted to the bin or drawer.

The exemplary embodiments discussed below will primarily be in the context of a divider that extends front-to-back along or above a supporting surface to partition the storage space. As can be appreciated, the divider itself can extend that entire depth or a portion thereof. It could also have relatively low height (FIG. 7) or a substantial height (FIG. 9A). Its size and configuration can, of course, vary. Additionally, it can be positioned in other directions in such spaces. One example would be laterally from left to right side or partially from left to right. And, such dividers could be utilized in other areas of a refrigerated appliance including in storage in the doors or the freezer compartment.

These examples will also be described in the general context of the lights turning on when the refrigerator doors are open. This is typical of automatic activation of lights in refrigerated appliances. However, they can be turned on and off by other triggers. Just a few examples would be a manual on and off switch, some sort of user interface (e.g., keypad, switches, touch screen, or other) that could allow selectable activation. It could also be triggered by such things as sensors. One example would be some sort of a touch or proximity sensor at or near the divider that would keep the lights off until the divider or shelf was touched by a user, or the user reached within a proximity of a proximity sensor. Still further, operation of the lighting sources on the divider lighting could be controlled in other ways than simply on and off. That could include light sources of different types on a single divider and controlled for different lighting effects. An example would be different colored light sources on the same divider which could be selectively operated to give different color outputs. Still further, the light sources could have their light output distribution patterns altered with different optical components. Examples could include lenses, diffusers, reflectors, or visors.

The examples will also be discussed in the context of the light sources being solid state sources such as LEDs. It is possible there could be other types of light sources.

B. General Form of Apparatus

In a more generalized context, an exemplary embodiment of an apparatus according to the invention mounts one or more LEDs to a divider of a space or a supporting surface in a refrigerated appliance. The set of LEDs (one or more) can be mounted on, at, or in a divider. Electrical power can be wired from each LED to a connection to electrical power that is available to the cabinet of the appliance. Additionally, and optionally, a controller or microprocessor associated with other refrigerated appliance functions can include connections that can control power to and operation of the LED source(s).

In this manner, illumination from the one or more LED arrays (hereinafter sometimes called the divider lighting subassembly) can provide light at and around a supporting surface in the appliance. The relatively small size of LED light sources and well-known methods of electrical connection to the LEDs can minimize use of space in the cabinet but place an illumination source out in the open space of that part of the cabinet.

In effect, the divider takes on multiple functionalities. It retains its physical partitioning function. But it also presents a mounting surface or location (it can be elevated) for light sources from the shelf supporting surface that can direct illumination out in the middle of the cabinet as opposed to along a cabinet liner side wall.

In the case of LEDs, operation tends to be more energy efficient at cooler junction temperatures. Positioning them inside a refrigerated compartment promotes improved efficacy (more light out for a given energy). They are also relatively small in size. They can generate different light output distribution patterns and colors.

Connection to electrical power of lights on a divider can be by hardwiring. But furthermore, temporary electrical connection is possible to facilitate movement of the divider relative to the liner. Movement of the divider with a divider lighting subassembly can be in the context of either a movable divider along a shelf, or a divider on a shelf that is movable either vertically or horizontally relative to the liner or cabinet.

In one embodiment, the temporary electrical connection could be a conductive terminal end of a power wire foamed into place in the liner. An opening aligned with that conductive contact could be formed in the liner. A complimentary or otherwise second contact that is hardwired to the LEDs on the divider can extend from the divider. When the divider is moved back to the liner or the shelf or supporting surface is moved back to the liner, the contacts on the divider and behind the liner can come into abutment to provide power to the LEDs.

Alternatively, hardwire with some slack could allow some range of repositioning of the divider and/or shelf relative to the liner to retain electrical power to lights on the divider.

Figure 1:
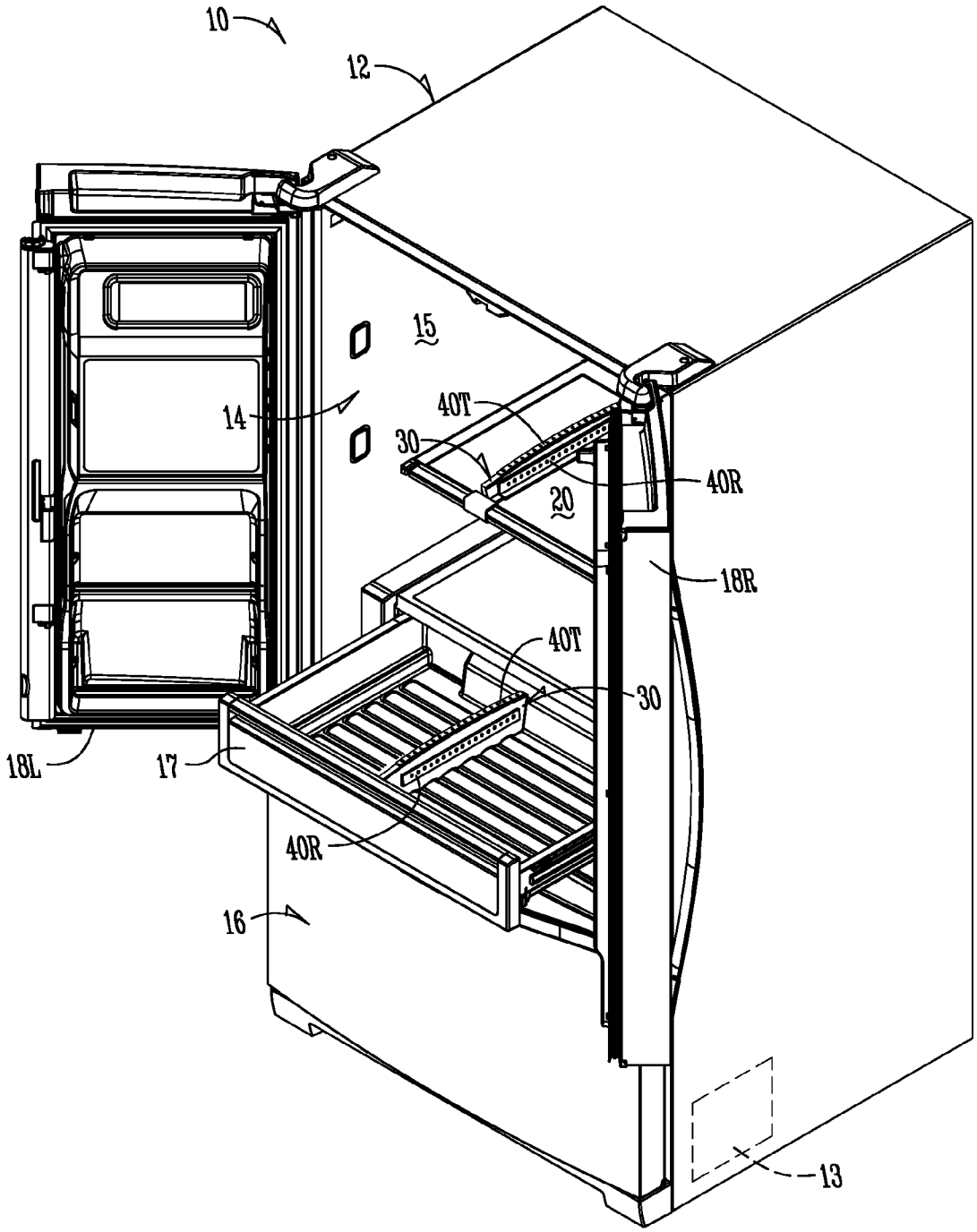
FIG. 1 is a perspective view of a refrigerator/freezer refrigerated appliance showing a fresh food compartment shelf and drawer, each with a divider according to an exemplary embodiment of the invention.
Figure 2:
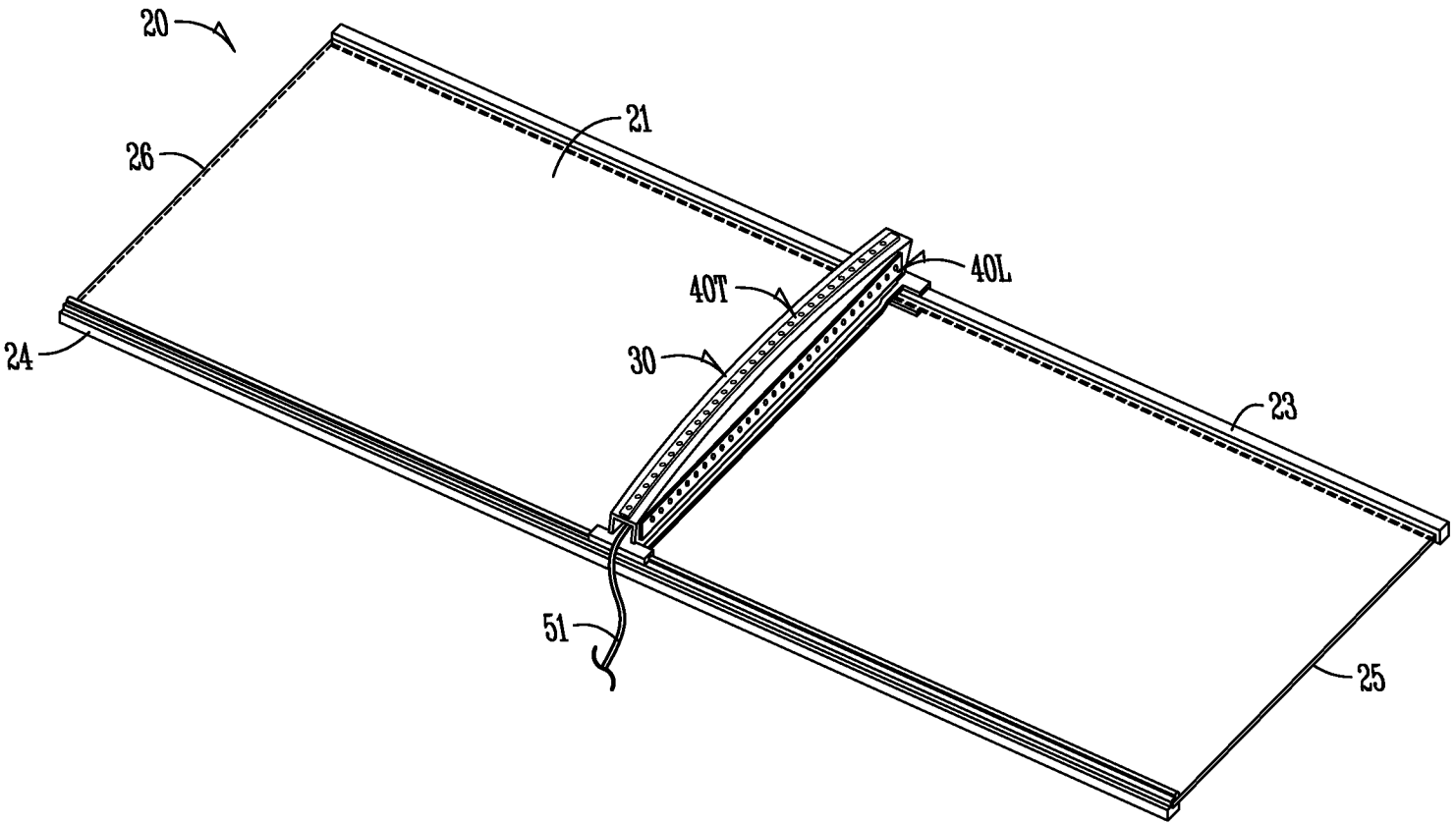
FIG. 2 is an isolated enlarged perspective view from top and back of the shelf and divider of FIG. 1 with added light subassembly.
Figure 3:
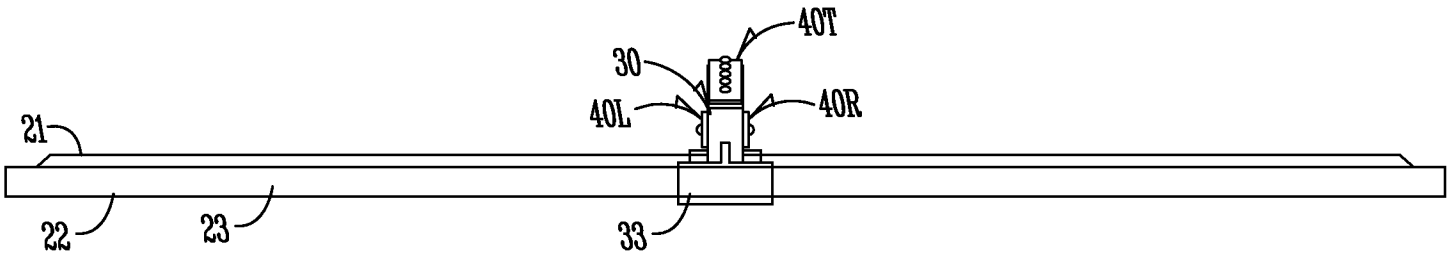
FIG. 3 is a front elevation plan view of FIG. 2.
Figure 4:
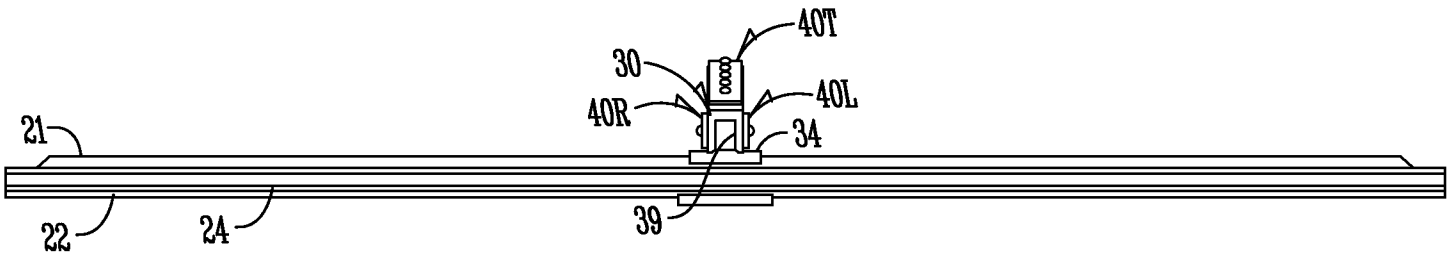
FIG. 4 is a rear elevation plan view of FIG. 2.

As can be appreciated, and as illustrated in FIG. 1, dividers can be placed in a variety of positions in the appliance. It is even possible to have plural dividers on one shelf or supporting surface.

In FIG. 1, a refrigerated appliance 10 includes a cabinet 12 with a refrigerated food compartment 14 and a freezer compartment 16 (bottom freezer type). Left and right doors 18L, 18R provide access to the fresh food compartment. One or more drawers 17 are a different form of storage than plain shelves and are slidable outwardly.

As shown in FIG. 1, one or more shelves 20 can be positioned in fresh food compartment 14. A liner 15 defines the perimeter walls of the fresh food compartment.

A power and control system 13 is located in cabinet 12 (shown diagrammatically). As is well-known, it is connectable to conventional distributed municipal electrical power. It can include a microprocessor or controller can manage power and monitor states or conditions of the appliance and manage different operational functions of appliance 10. Examples of such power and control can be found at U.S. Pat. No. 7,765,819, incorporated by reference herein, and published U.S. Application No. US 2009/0277210, incorporated by reference herein. Examples of different ways to supply power, including to shelves that may be removable, as well as providing instructions from a centralized controller to other components can be seen in U.S. Pat. Nos. 6,813,896, 7,293,422, and 7,338,180, all incorporated by reference herein. Power can be supplied by temporary contact of conductive members on a shelf and in the liner or even through touchless transfer (e.g., inductive electrical transfer). A wiring bus from power and control to various parts of the appliance can communicate electrically with the various locations.

As further shown in FIG. 1, further partitioning of the variety of storage locations in any of the compartments can be accomplished through dividers 30. This can be on a supporting shelf in the fresh food compartment that can be opaque or transparent or partially light transmissive. Such shelves can basically be flat and planar. An example would be a glass shelf either with or without an overmolded frame. Such dividers 30 could be fixed in place or removable. Their function is to provide a physical partitioning of that horizontal storage area.

In an analogous manner, a similar divider 30 could be placed above the horizontal planar supporting surface (essentially a shelf) that is the bottom of a drawer 17 in the fresh food or freezer compartment.

Therefore, here and elsewhere in this description, the term "shelf" can refer to the shelf such as shown in the refrigerated compartment 14 in FIG. 1 or a supporting surface or shelf at the bottom of a drawer like drawer 17. The term "shelf" will also sometimes refer to just the bottom supporting surface of any storage surface whether in a bin, basket, shelf, drawer, or any other storage. Other examples of dividers can be seen in U.S. Pat. Nos. 6,880,903, 7,229,143, and 7,566,105, all incorporated by reference herein. Of course, these are only a few examples.

Such dividers 30 are known in the technical field and can take a variety of different configurations. As a general rule, they tend to be made of plastic so that they can be economically reduced in various shapes and forms. They tend to be relatively lightweight. They also tend to be relatively thin to minimize the amount of storage space they take up. They can be relatively low height or can extend substantially upward from the surface on which they partition. They tend to extend from the front vertical plane of the storage surface to its rear. However, they can take many configurations and these are examples only.

As can be seen in the other drawings, the general apparatus according to the invention adds one or more light sources (one example is LED lighting assembly 40) to any of these types of dividers. This divider not only continues to function as a physical partitioner of a horizontal storage surface, space, or level but also as placement of one or more light sources above the supporting surface and intermediate opposite sides of the liner. This presents the ability to place an illumination source inside of the space of the compartment instead of along a side wall.

As can be appreciated and as is described regarding other embodiments herein, electrical power can be hardwired or there can be temporary connections of electrical power to the lights on the divider. This allows the divider lighting subassembly light source or sources to be powered in a variety of contexts including when the divider is fixed relative the shelf, when the divider is fixed on the shelf relative to the liner, or when the divider is movable relative to the shelf and/or the divider.

General Operation Principles

With regard to a divider lighting subassembly associated with a divider for a supporting surface or shelf in a refrigerated appliance, different operational schemes can be applied.

One is simply to turn the one or more light sources on when a refrigerator door 18L, 18R is opened or, if divider 30 is in a drawer 17, when drawer 17 is opened. Another is to have a manually-activated switch.

Other alternatives are possible and widely varying. For example, if the divider lighting subassembly lights could be turned on when a door 18L, 18R is open but if the supporting shelf the divider is related to is slid forward, they could be turned off. This would allow essentially local task lighting at the top of the supporting surface associated with the divider to allow a user to have better visualization of what is supported on the shelf when the door is first opened. But then once the user identifies the shelf or supporting surface of the item of interest, sliding the shelf out no longer would likely require such focused illumination. The lights could be turned off to save energy.

By further example, however, by selection of the type of light source(s) and placement, various other lighting schemes are possible. One would be to have different colored light sources on a single divider. The colors could change. There could be user selection of color type relative to either desirable aesthetics (e.g., user selectable mood lighting) or to help the user identify a purpose of a given supporting surface (e.g., for storing certain types of food).

Still further, operation could include having a manually activated switch for each divider light subassembly such that if the user did desire additional illumination at or near that shelf level, he/she could manually select the same.

Still further, power or other driving of the light sources could be varied for varying effects. An example would be that the lights on the divider could at first be at full intensity when the door 18L, 18R is opened but slowly diminish in intensity over time. The reverse could be true.

Another example would be to increase the intensity of the light sources if ambient conditions demanded such. In other words, in daylight more intensity might be needed but in nighttime or with less ambient light, less intensity would be needed.

As can be appreciated, other lighting schemes can be utilized including in combination with other lighting in the appliance or other states or functioning status of the appliance.

Still further, the designer can elect certain other characteristics of the divider lighting subassembly for different effects.

For example, LEDs come in different power ratings with different output intensities and distribution patterns. Some have Gaussian patterns and some "batwing" patterns, just to name a few. The angle of output can vary from wider output to more collimated.

Additionally, color of output can be selected over several choices. Some examples are blue, red, and white. But additionally, filters in the nature of optics, coatings, and the like can produce still further colors or lighting effects. Additionally, operating different colored LEDs in different combinations can produce different composite effects.

As mentioned, the design of the lighting can be in combination with other components of the appliance. For example, shelf 20 in some cases is made of glass. The optical nature of glass is that it is at least substantially light transmissive. It can have some reflective characteristics depending on angle of incidents of light to its surface. But as can be appreciated, placement of lights on a divider out in the middle of space of the compartment can direct light at or near that shelf. However, if the shelf has light transmissive characteristics, light can pass through and illuminate other parts of the interior of at least space around the shelf, if not the whole compartment if no other light blocking components exist. Thus, depending on the type, number, output distribution patterns, and other components in a compartment, a single lighting subassembly 40 could provide illumination for a whole compartment. Alternatively, if desired, the material of the surface of the shelf or other supporting surface could be reflective, light dispersive, light absorbing, or opaque depending on desire or need. Furthermore, optical coatings could be applied to glass to alter its optical qualities over the entire glass surface or portion thereof. Still further, at least some of the light output from the divider light assembly could be directed into a component that could guide or direct light to other areas of the appliance. An example would be a material that constitutes a light guide or light pipe that would receive light from one or more light sources and guide it through its material to exit at a place spaced from the light sources. Such light pipes or guides can also transmit light and at the same time radiate some of it. An example of a light guide or pipe is described at U.S. Publication No. US2011/0085287, incorporated by reference herein. Thus, the lighting designer has options regarding how light from the divider lighting subassembly or subassemblies can be distributed.

The point is that by selection of the type of LEDs, and any optics that can be utilized with them, a variety of different light output distribution patterns and effects can be possible. Still further, the designer could mix and match LEDs of different characteristics on the same divider to add a further variable or effect. And, with a little more complexity, different LEDs on a single divider could be operated at different times or in different combinations, or at different power levels for still further effects.

Also, other optical features could be used in combination with the divider lighting subassembly. For example, the design of the surrounding surfaces to the divider and its lighting subassembly could be selected for optical characteristics. In one example, glass by nature has light transmissive characteristics and reflective characteristics depending on angle of incident of light and its nature. A glass shelf or supporting surface therefore could be utilized by the designer to redirect light from the divider lighting subassembly in a manner that is desirable. For example, it could reflect light in sufficient amount to illuminate other portions of a compartment of the appliance 10. But it could also transmit light to illuminate other portions of the compartment below the shelf. Reflective surfaces or coatings, or light absorbing or diffusing surfaces could also be utilized by the designer for different effects.

In some cases, it is possible that just a single set of light sources on a single light source assembly for a single divider could illuminate an entire compartment. On the other hand, the designer can select the lighting subassembly for just one divider for more localized task lighting instead of trying to illuminate a larger area.

Specific Examples-Divider Movable Along Shelf

By referring to FIGS. 2-8, one specific exemplary embodiment includes essentially a rectangular planar shelf 20 having a top surface 21, a bottom surface 22 (see FIG. 3), front edge 23 (in this example including an overmolded frame), a back edge 24 that is overmolded plastic or another material or added edge, and opposite side edges 25, 26. A divider 30, such as is generally indicated in FIG. 1, extends from front edge 23 to back edge 24 on or above shelf or supporting surface 20. Several divider lighting subassemblies 40 are mounted on to divider 30. A top set of LEDs 40T is mounted on divider 30. Left and right sets 40L and 40R are mounted on the opposite sides of 30. Electrical power to the LEDs on a subassembly 40 is by hard wire 51.

As illustrated in FIGS. 3-8, divider 30 and divider lighting subassemblies 40 are shown in more detail.

Divider 30 includes a front end 33 (see FIGS. 3 and 8) that curves over a substantial part of front edge 23 of shelf 20. It has a flat bottom plate 32 that extends back to back end 34. Back end 34 of divider 30 wraps partially around the overmolded back edge 24 of shelf 20. In this manner, divider 30 can basically be mounted on and resist forward or backward movement relative to shelf 20. However, this would allow divider 30 to be slid side-to-side or laterally along shelf 20. By appropriate geometry of divider 30, there could be tension between its opposite ends 33 and 34 when mounted to shelf 20 to frictionally or otherwise deter lateral movement. The user would simply have to overcome those forces to slide it to a desired position on shelf 20. Divider 30 could basically snap onto the front and back edge 23 and 24 of shelf 20.

Figure 8:
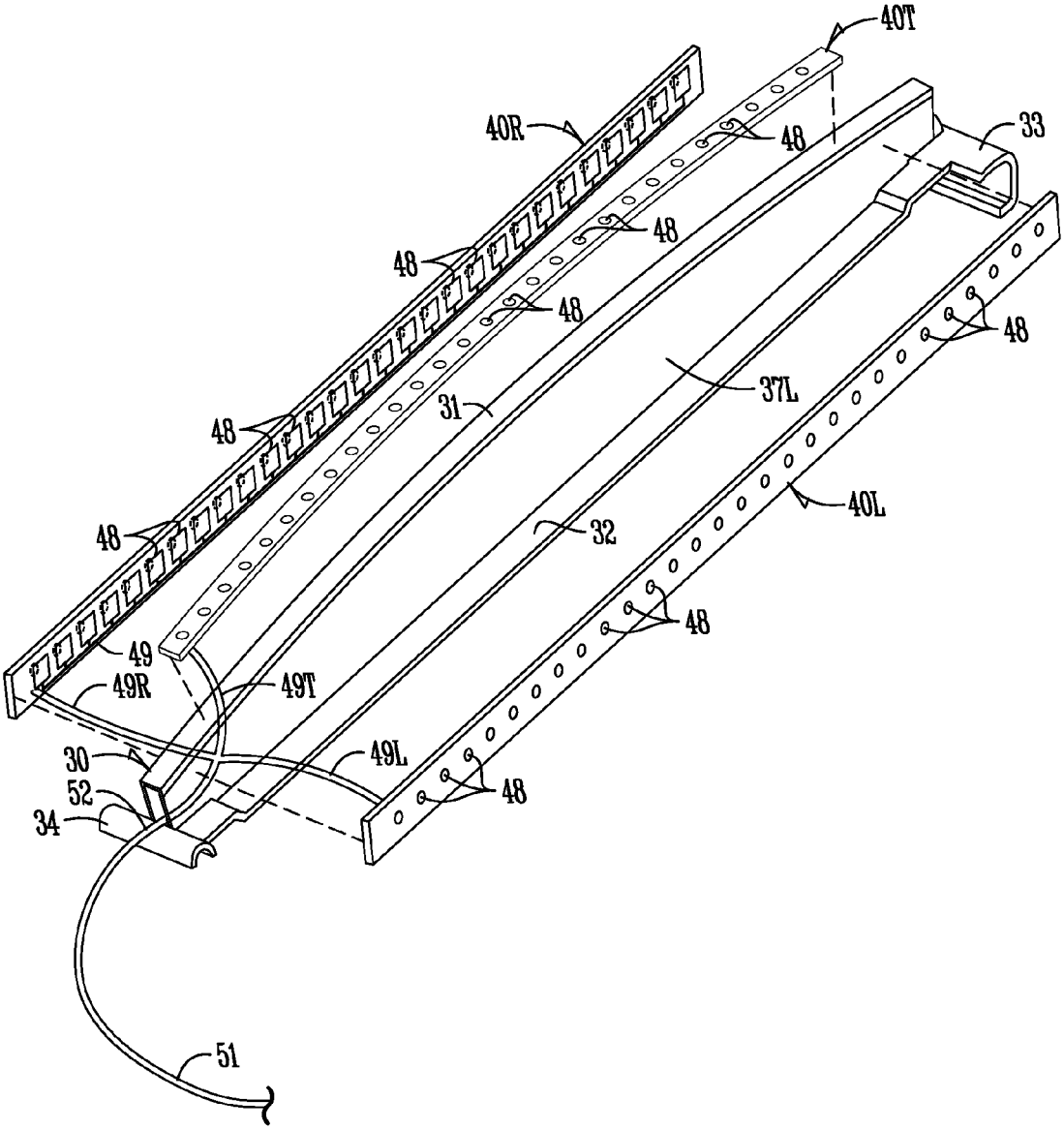
FIG. 8 is an enlarged exploded view of the shelf divider of FIGS. 2-7 showing three printed circuit board LED light arrays and how they would be mounted to the divider and how power would be supplied from an electrical power source.

As shown in FIG. 8, divider 30 also has spaced apart vertical divider walls 37L and 37R that extend from bottom plate 32 up to a top flattened surface 31. This leaves basically a hollow interior space 38 between walls 37L and 37R all along divider 30.

In this configuration, divider 30 can be molded out of plastic and be relatively lightweight yet rigid enough for physically dividing or partitioning shelf 20. It can also be relatively thin in each of its cross-sectional dimensions to minimize the amount of space it takes in the cabinet of appliance 10.

But additionally, as can be seen, divider 30 presents multiple surfaces upon which printed circuit boards (PCBs) bearing LED light sources 48 can be mounted.

In this example, three thin elongated PCBs with plural LED dies 48 are mounted to divider 30. One board 40T mounts to top surface 31. Its LEDs 48 would therefore have optical axes pointing straight up. Second board 40L can be attached or mounted by any number of techniques along divider wall 37L (essentially its left side). The optical axes of LEDs 48 would basically project horizontally to the left. That array of LEDs 48 would thus project basically parallel and slightly above the horizontal surface of the relevant shelf 20.

Similarly, a third board 40R would mount on the opposite of divider wall 37 and project axes horizontally in the other direction (right) and generally parallel and above shelf 20. As is known in the art, if LEDs 48 are selected to have beam output distribution patterns that diverge, although the optical axis of each LED would extend basically parallel above the shelf surface 21, the beam would spread and be incident to the surface of shelf 20. As previously mentioned, if shelf 20 is glass, some light would pass through and provide illumination below shelf 20. Some would refract and some could reflect to other areas inside the fresh food compartment. Still further, depending on the nature of liner 15, light would likely strike it and at least partially reflect.

As illustrated in FIG. 8, one potential aspect of this type of configuration is that boards 40 do not necessarily have to be flat or in a single plane. As illustrated in FIGS. 3-8, the board could be curved (see board 40T) to follow a curved mounting surface or simply be mounted in curved form. This could spread the optical axes in a plane through each of the LEDs 48. Alternatively, it could be convex or could even be of combined shape (convex, concave, flat, stepped, or other configurations). It could be made in other shapes or form factors to conform to other surfaces or mounts.

Additionally it is to be understood that LEDs 48 do not need to be in a linear array along any board 40. For example, they could be in clusters of two, three or more or offset or in multiple rows or other configurations.

As further illustrated in FIGS. 1-8, electrical connections to each LED die 48 can be on the backside of boards 40 by electrical connections 49 (see FIG. 8). Those electrical connection can be either serial conductive traces on the board or could be some sort of more complex printed circuit such that electrical power and control to each LED could be individualized. Still further, conductive connections 49 could be some sort of wiring harness along the backside of each board. These conductors could also be on the front side of the board but more protection might be given if on the backside. As diagrammatically illustrated in FIG. 8, electrical connection 51 from cabinet 12 could branch out to each LED light subassembly 40L, 40T, and 40R. Each branch 49L, 49T, and 49R can connect individually to each LED 48. Boards 40 can be manufactured and applied to divider 30 by screws, bolts, adhesive, clamps, interference fit, or other methods to mount them in place. By appropriate routing of electrical connections 49, they can all terminate at rear end 34 of divider 30 and by any number of conventional means hardwire-connect to the distal end 52 of a power connection having a proximal end 51 in electrical communication with an electrical power source. Power connections 51, 52 can be a part of a wiring harness 50 such as is well-known and which can be foamed in behind liner 15 of appliance 10.

Figure 5:
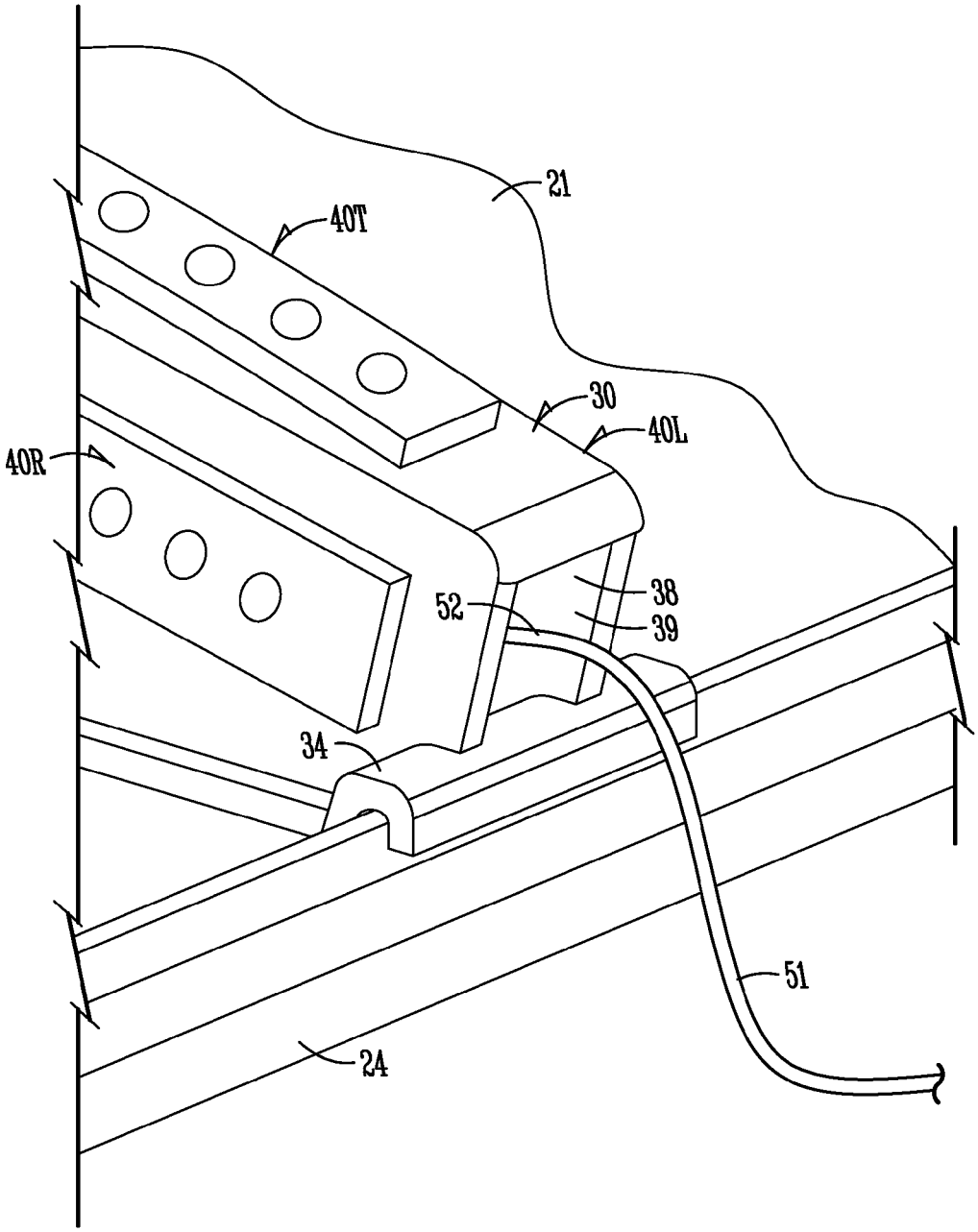
FIG. 5 is an enlarged partial perspective view of the divider and light subassembly at the back of FIG. 4.
Figure 6:
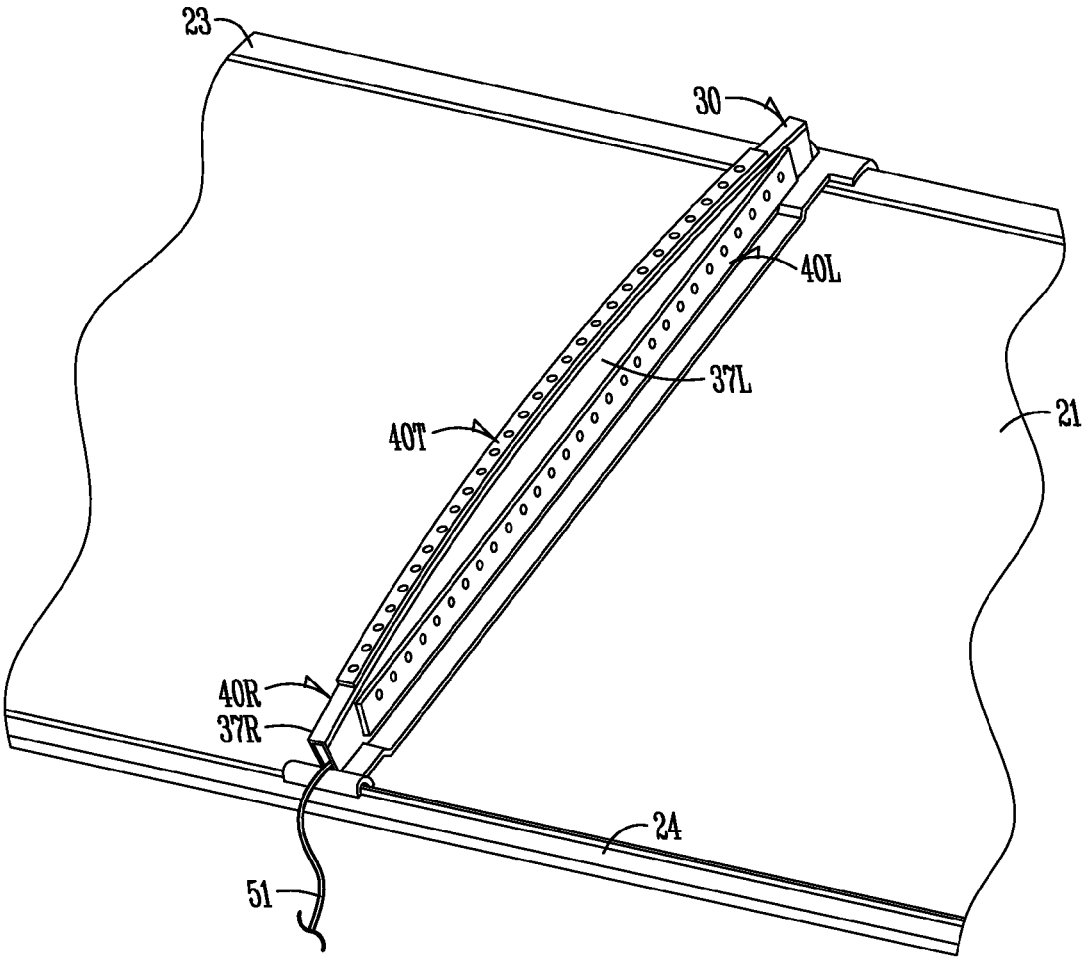
FIG. 6 is similar to FIG. 2 but slightly enlarged showing how individual printed circuit board arrays of lights can be mounted to the shelf divider of FIG. 2.
Figure 7:
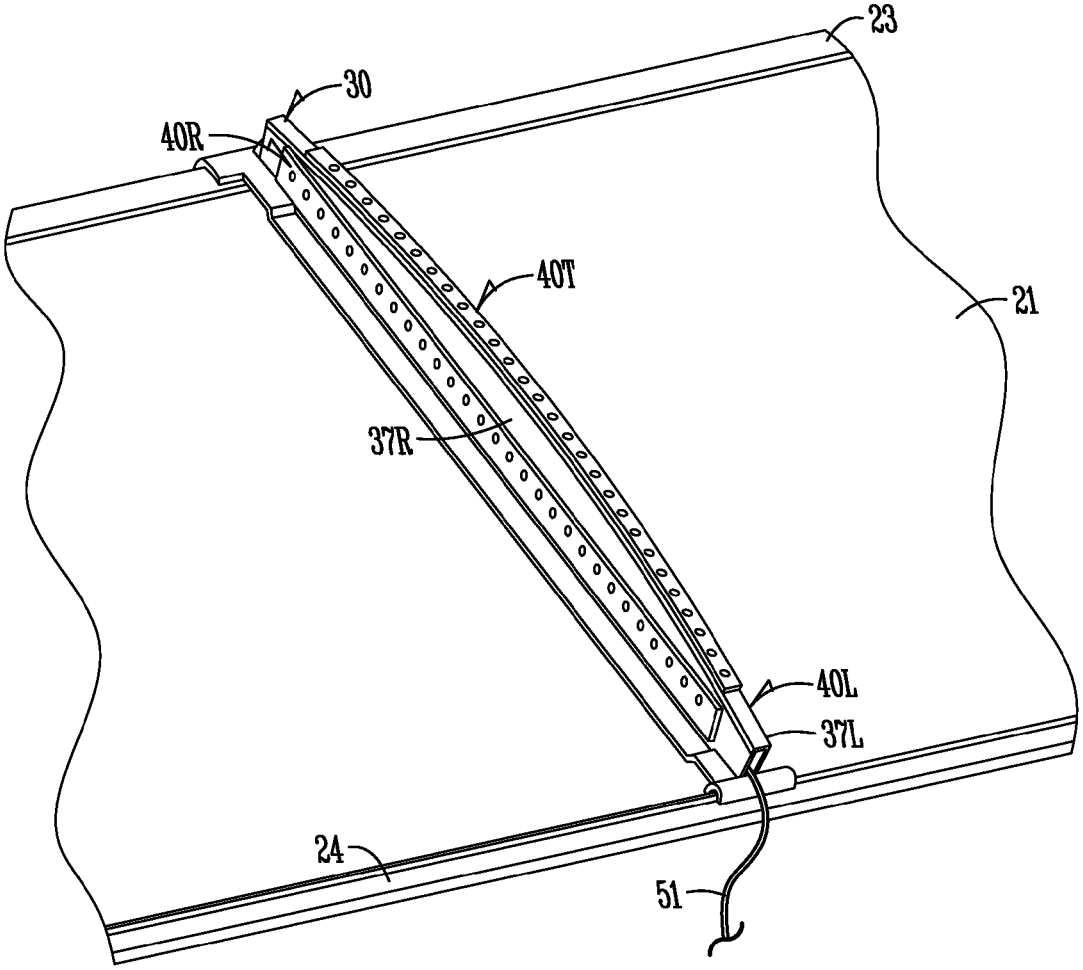
FIG. 7 is similar to FIG. 6 but from a different perspective.

FIGS. 6 and 7 illustrate boards 40R and 40L mounted on opposite sides of divider vertical walls 37L and 37R. FIG. 5 shows all three boards 40T, 40R, and 40L mounted and that harness 50 from liner 15 could have an opening 39 to enter to the hollow interior 58 of divider 30 to reach the backside of each board 40 for electrical communication.

As can be appreciated, divider 30 could be produced in a configuration such that it would present mounting surfaces for each of boards 40T, 40L, and 40R but have a fully or partially hollow interior 38 in which a wiring harness could run its length and hook up to individual LEDs 48 through openings in those divider walls. Different configurations of divider 30 are of course possible. Also, LED dies could be inset into the walls of divider 30 or mounted over those walls.

As can be further appreciated, boards 40 could include other circuitry or components that would be beneficial for a lighting operation. For example, a thermal management component could be added to boards 40 to try to conduct or disperse heat from the LEDs. Another option would be to have an active circuit on any of the PCBs. That active circuit could include a microprocessor or other electrical or electronic components that could be used to operate the LEDs by appropriate instruction or preprogramming or user selection. Additionally, it is to be understood that each LED could be individually driven for individual lighting effects. Or the entire set could be driven in the same manner. Still further, subsets of LEDs could be driven independently.

The materials for divider 30 can vary according to need or desire. For example, any number of plastics that are acceptable for the thermal ranges of these appliances and in the presence of food are well-known in the technical field. The amount of strength and rigidity, durability can be selected according to weight, mounting methods, and other factors associated with the divider lighting subassemblies and the use of the divider 30.

Divider Movable with Shelf

Figure 9B:
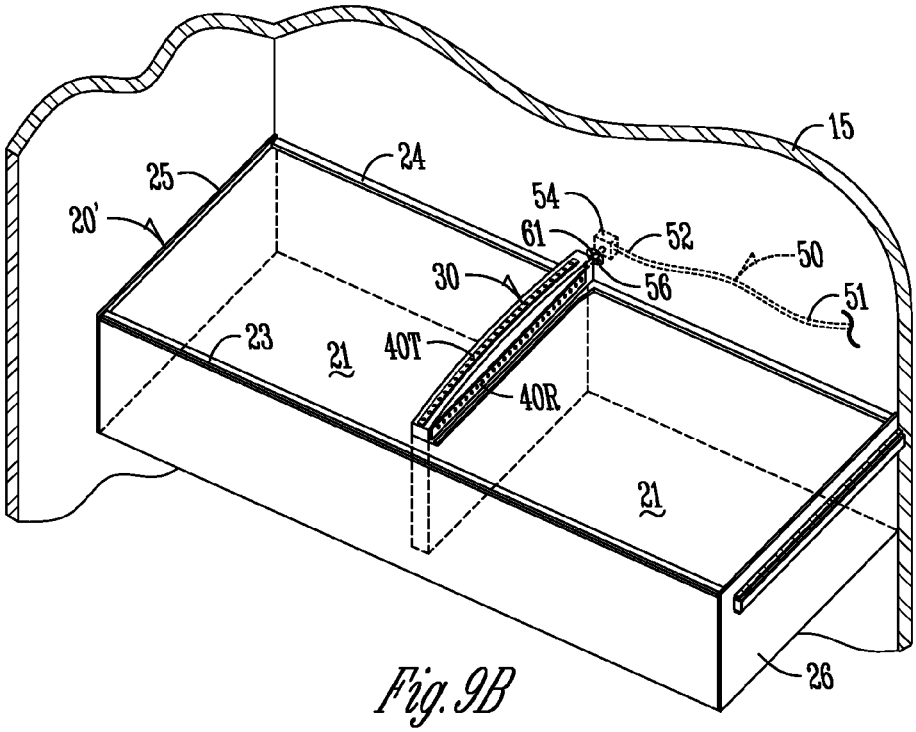
Figure 11:
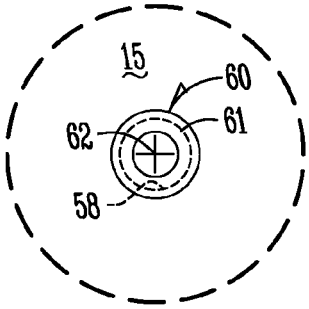
FIG. 11 is an enlarged isolated front elevation plan view of a sealing member in the liner of the refrigerator cabinet of FIG. 10 that allows temporary passage of an electrical connection from inside the liner to the light assembly on the divider.

FIGS. 9A-B to FIG. 11 illustrate an alternative specific exemplary embodiment according to the invention. It utilizes the same or similar general concepts of prior embodiments. It includes divider lighting subassemblies 40 on a divider 30 for a storage surface for an appliance 10. Some specific differences are as follows.

As illustrated in FIGS. 9A-B, the shelf or supporting surface associated with divider 30 is a drawer or bin 20'. It still has a supporting shelf or surface 21 like that of the first example but it includes upwardly extending perimeter sidewalls that essentially define space above surface 21.

In this embodiment, drawer 20' (e.g., a drawer, bin or basket) can be slid forwardly (FIG. 9A) from the home or back position shown in FIG. 9B. This can be by any of a number of conventional or other techniques such as slides, glides, or rails. This allows a user to pull the supporting surface 21 forward for better access.

Figure 10:
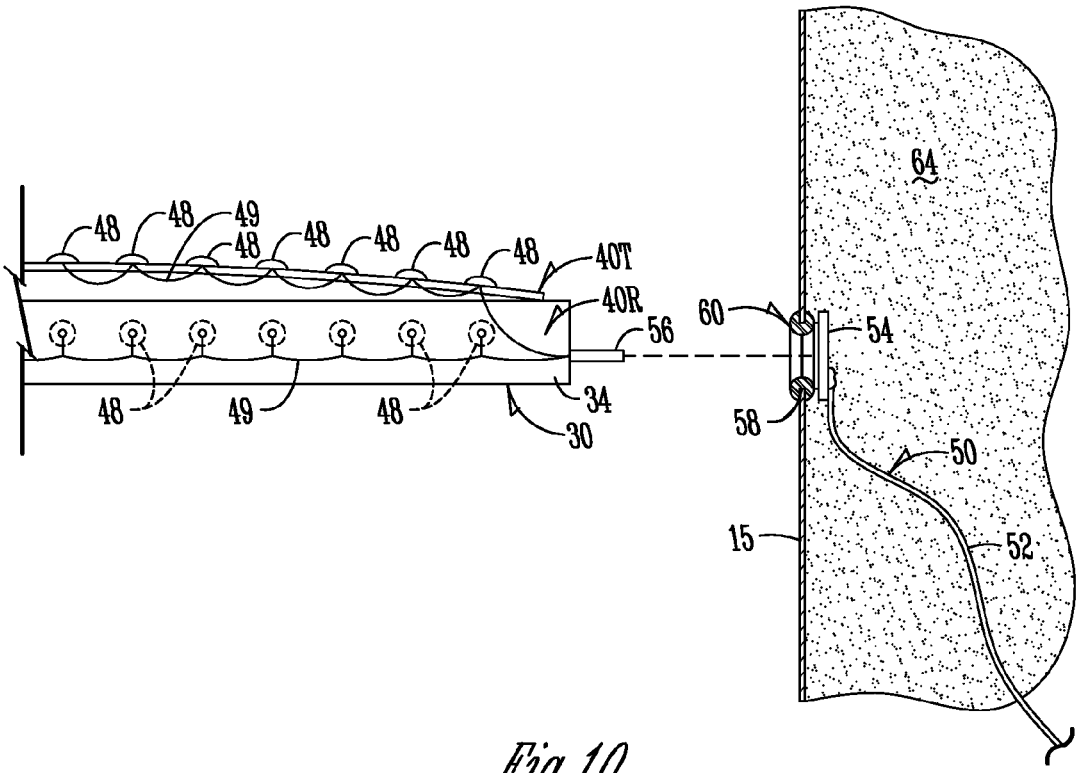
FIG. 10 is an enlarged isolated side elevational, partial section and diagrammatic view of one exemplary form of a temporary power connection between the printed circuit boards of LED lights on the divider and an electrical contact in the liner of the appliance that can be used for supplying electrical power to the light subassembly in FIGS. 9A-B.

A further difference is that electrical power to boards 40T, 40R, and 40L is temporary. As also illustrated in FIGS. 10 and 11, wiring harness 49 to each LED 48 for each board 40 is routed to a common conductive contact 56 at the rear end 34 of divider 30. Contact 56 can be a metal finger, needle or tab that is electrically conductive and exposed. It can take other forms.

As illustrated in FIGS. 9A-B to FIG. 11, wiring harness 50 behind cabinet liner 15 can include an electrical power line having a proximal end 57 connected to electrical power and distal end 52 connected to a conductive contact 54 (also behind liner 15). An opening 58 formed in liner 15 has positioned in it a closable seal 60 (grommet, plug, or the like) having an outer perimeter 61 that would interference fit or otherwise fit in opening 58 in liner 15. Its center 62 is either small in size as an opening or has slitted flaps that would normally close off the entire sealing member. However, when drawer 20' is slid to its home position, the geometry (size and extension) of contact 56 is such that it enters, passes through, and then contacts foamed-in-place liner contact 54 to provide an electrical path to electrical power. The sealing member 60 substantially seals or holds closed any airflow path through opening 58 to deter loss of cool air through it. When drawer 20' is slid open, contact 56 separates from foamed-in-place contact 54, which disconnects the electrically conductive path to power, and no electrical power is available to light boards 40 on divider 30. If power is otherwise provided to liner contact 54, lights on divider 30 can be turned on when shelf or drawer 20' is slid back to home position.

This allows a lighting subassembly to be mounted on a divider 30 even when the shelf or drawer or other supporting surface moves relative to the liner. As indicated in FIG. 10, liner contact 54 and its hardwire connection 50 can be foamed-in-place when the refrigerated appliance is being constructed. Such foam (see reference numeral 64) is utilized to thermally insulate the cabinet 12. By placing liner contact 54 directly in line with grommet 60, and in relatively close proximity to it, at least a portion of it is exposed for contact by divider finger contact 56 when it is inserted through grommet 60. An alternative temporary electrical contact is described at U.S. Pat. No. 7,338,180, incorporated by reference herein. Others are possible. This illustrates one example of how electrical power to the divider lights can be supplied but still allow the shelf or drawer to be moved (e.g., slid forward or moved to a different vertical position). If moved to a different vertical position, there could be a liner or electrical contact 54 at each vertical potential position along the liner. Another example would be utilizing power through power strips vertical in the cabinet. Conductive power transfer is also possible.

FIGS. 9A-B to FIG. 11 show a small finger or needle for contact 56 and a relatively small foamed-in-place liner contact 54. Those conductive surfaces could also be spring-loaded contacts or motor brushes or other temporary electrical connections. They could also take the form of essentially an electrical plug to an electrical socket.

The materials of which the temporary connections are made are within the skill of those skilled in the technical field. The sealing member can be electrically insulative or dielectric. The contacts are electrically conductive. By making the electrical connection through the sealing grommet 60 and inside the liner, humans are shielded from coming into contact with the foamed in contact 54.

Fixed Divider to Liner

Figure 12:
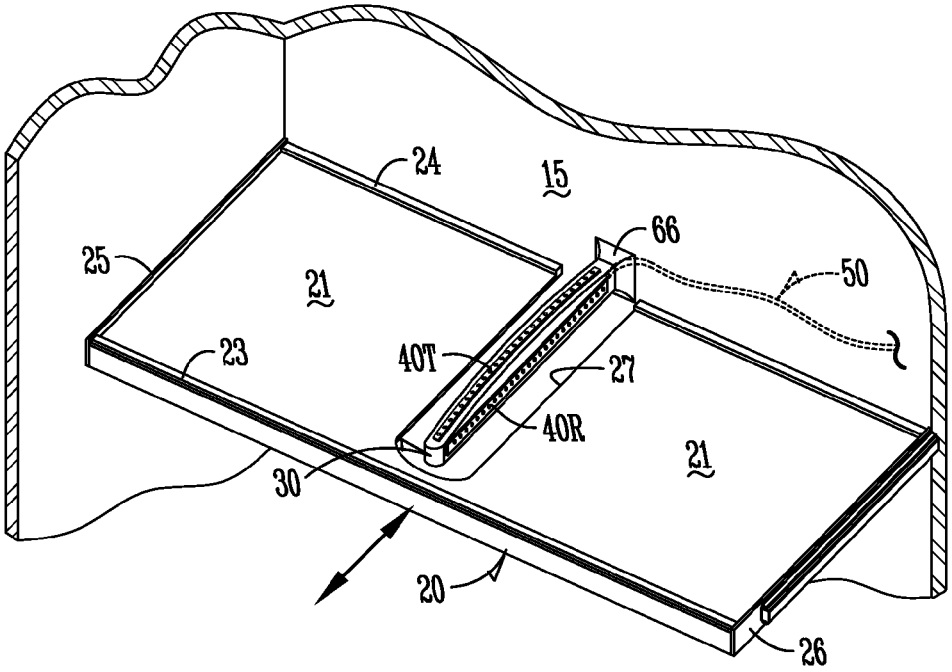
FIG. 12 is a top plan view of a still further alternative embodiment according to the present invention, where a divider bearing a light subassembly is fixed to the cabinet liner and a shelf is slidable or movable vertically or horizontally relative to that divider.

FIG. 12 shows another specific exemplary embodiment according to the invention. Again it uses one or more lighting subassemblies 40 on a divider 30. The main differences are as follows.

Divider 30 is mounted to or integrally a part of liner 15. This is diagrammatically shown by mounting interface 66 in FIG. 12. Mounting interface 66 can be either the rear or backend of divider 30 and could be attached or fixed to liner 15 by adhesive, some clamping means, or otherwise. Alternatively, mounting interface 66 could be a part of and/or molded as an integral part of liner 15 and divider 30 attached to it. Other ways of mounting the divider with lighting subassembly to liner 15 are possible. Circuit boards (40R, 40L, and here 40T) with light sources are mounted to divider 30 and hardwired to harness 50 which is foamed into liner 15. Divider 30 does not move relative to liner 15.

In this embodiment, shelf 20 can be positioned at or near divider 30 and its lights. It can include a cutout 27 such that shelf 20 can be positioned around the divider 30. Alternatively, divider 30 could extend just above the surface of a rectangular shelf 20.

In this example, shelf 20 could be slid forward or back (to home position shown in FIG. 12). Lights on divider 30 will always have electrical power. They could therefore be turned on and off at any time regardless of position of shelf 20. Additionally, shelf 20 could be raised or lowered vertically relative to divider 30. Power would always be available to the light on divider 30.

Fixed Divider Relative to Split Shelf

Figure 13:
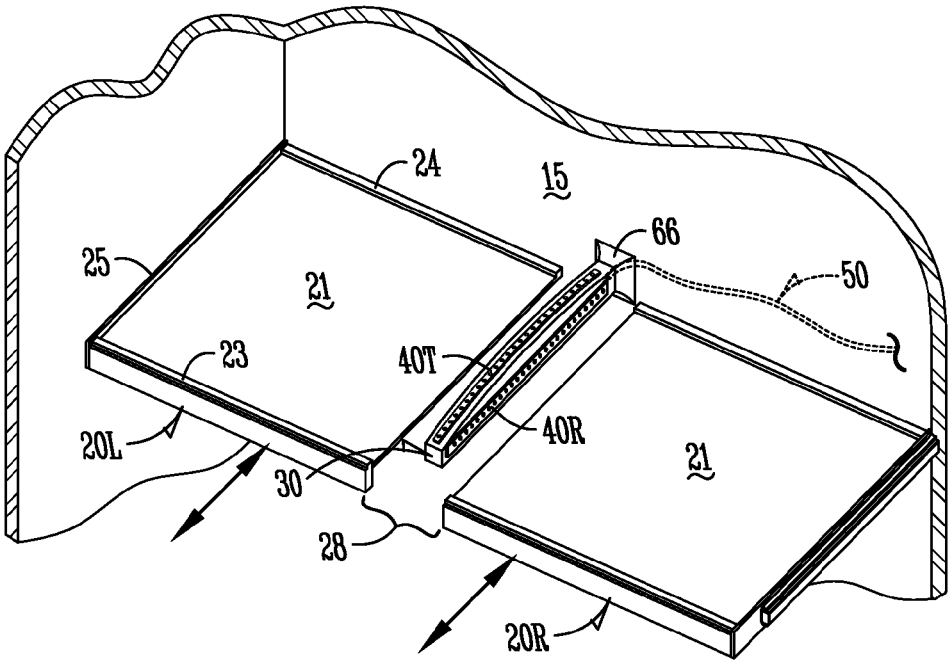
FIG. 13 is a top plan view of another exemplary embodiment of the present invention where the divider carrying the light subassembly is fixed to the liner but the shelf or supporting surface has two independent members on opposite sides of the divider.

FIG. 13 shows another specific exemplary embodiment. It is similar to that of FIG. 12 with the following principle difference.

Instead of a single piece shelf 20 relative to fixed divider 30, the shelf could be in two independent sections (20R and 20L). Each could be independently slidable forward or independently removed or raised and lowered vertically. In all cases, electrical power can be always available to the lights on divider 30 which extends from liner 16 at mounting interface 66.

If shelves 20R and 20L have glass at least as a top surface and divider lighting subassembly light sources are on, a customer can see in which shelf an intended food item is stored. When the customer wants to remove that item, the respective side of that storage level, in other words either shelf half 20R or shelf half 20L can be slid forward to retrieve the item. The lights on divider 30 can be left on or they can be turned off when the shelf side is slid forward. Optionally one LED subassembly could be turned off when a shelf section is slid forward. Glass would help reflect light for this illumination function. As with all embodiments, the LEDs could be a single color or different colors, or operated to turn different colors on at different times or under different conditions.

Options and Alternatives

As can be appreciated from the foregoing, the invention can take many forms and embodiments. Certain features described can be mixed or matched. Variations obvious to those skilled in the technical field are included within the invention.

A few additional examples of options and alternatives are as follows.

As mentioned, if the shelf or supporting surface is opaque, it could be made of material that could be anywhere from somewhat reflective to highly reflective. It could also be made of light absorbing or significantly light diffusing or dispersive qualities. However, if glass or other coatings or materials are used at least on the top surface, they themselves can be designed to be substantially or partially reflective if needed as can sides of the liner or other components in the relevant compartment.

On the other hand, if a shelf or supporting surface is of a certain material it can be anywhere from partially light transmissive to substantially transmissive such as transparent and therefore could pass a substantial amount of light from just a single divider to other parts of the compartment.

Figure 14:
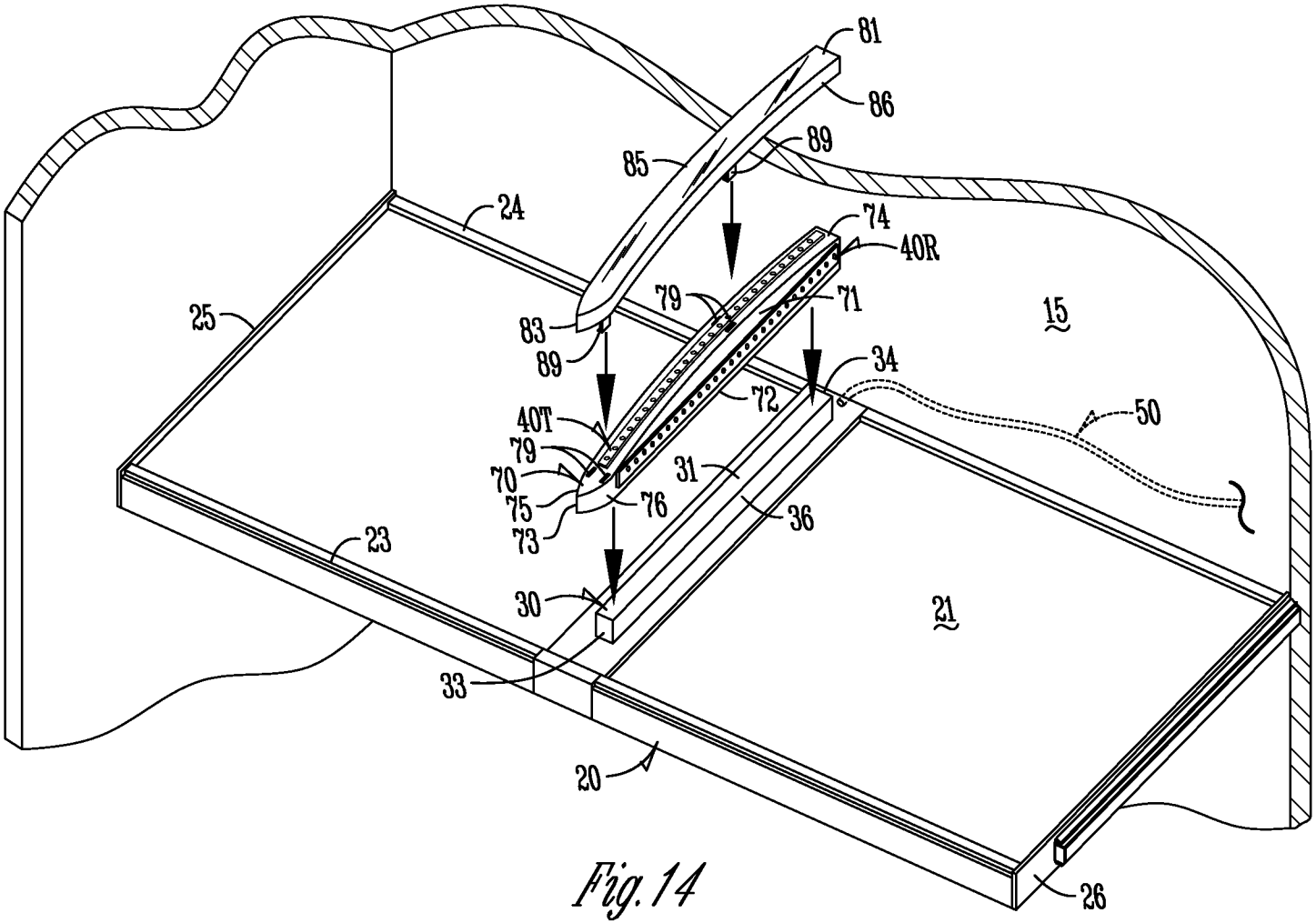
FIG. 14 is an enlarged perspective view of an optional light subassembly that can be mounted on a divider and an optional lens or cover that can be utilized with the light subassembly.
Figure 15:
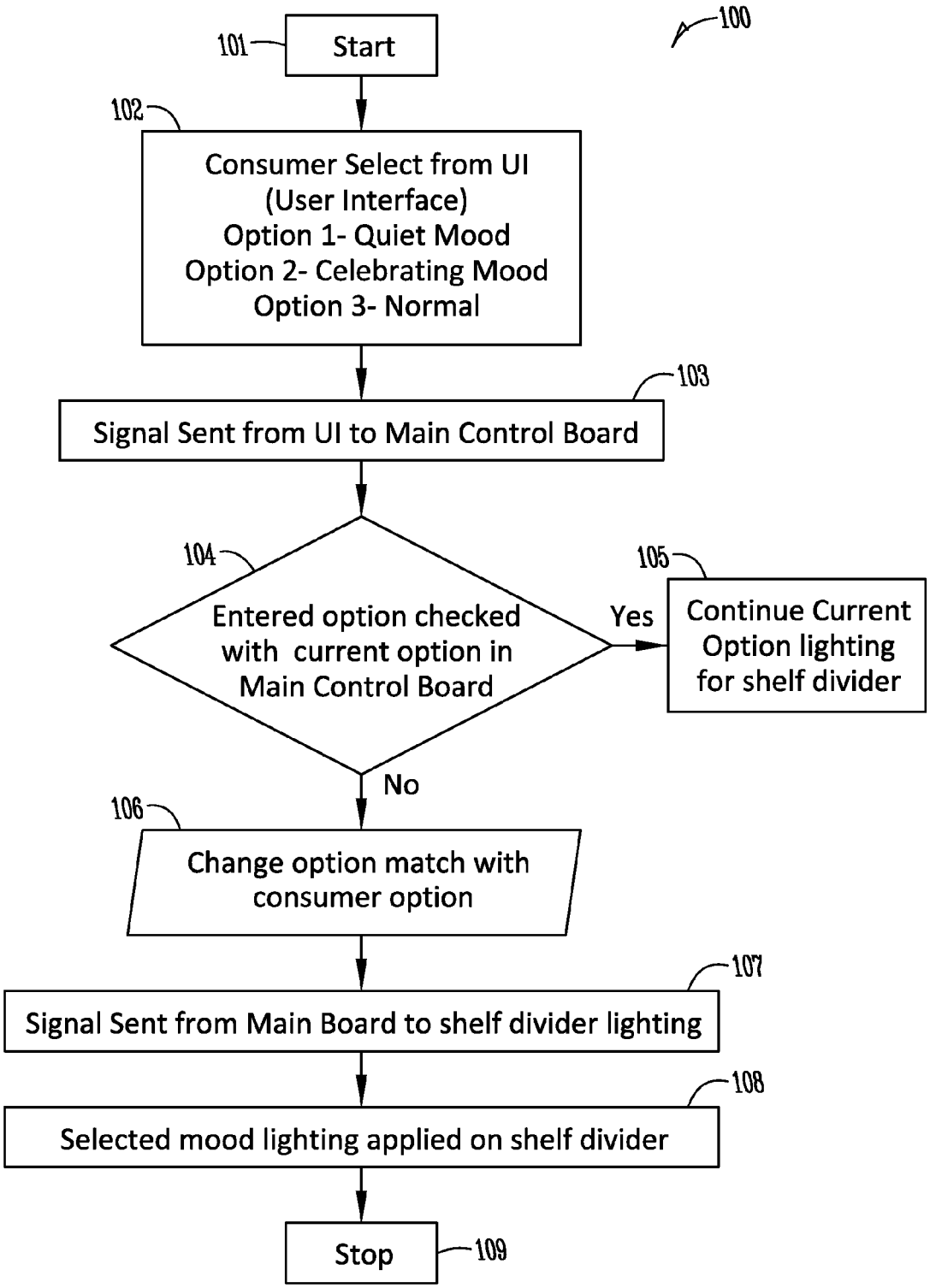
FIG. 15 is a flow chart algorithm diagram showing an optional method of operating a light subassembly on one of the dividers of the exemplary embodiments.

Another example is use of other optical components with the divider-mounted light sources. An example can be seen in FIG. 14. In this example, a divider 30 can be mounted on shelf 20. A separate plastic enclosure or housing 70 can be formed for receiving the mounting of light sources 48 or PCBs bearing light sources 48. A wiring harness (like harness 49 of previous embodiments) can be assembled into housing 70. Housing 70 can have top 71, bottom 72, front end 73, back end 74 and left and right sides 75, 76 correlated to corresponding portions of a divider 30 and be placed over the divider 30 in the position. It can simply be mounted over, snapped to, or removably or fixedly mounted to divider 30. In this embodiment boards 40T, 40R and 40L could be mounted on the exterior of housing 70 or on the interior. If on the interior, openings could be appropriately formed so that the output from each LED could be emitted from housing 70. This would further protect the circuit boards. Alternatively, the material of housing 70 could be transparent, translucent or light transmissive for at least the light sources 48 and boards and LEDs 48 completely enclosed in housing 70. Further optics such as additional lenses or reflectors or visors could be added or built in to housing 70.

A further possible option could be an additional optical component, such as lens 80, could be added or not depending on whether an additional optical manipulation of light is desired. For example, housing 70 could have apertures 79 to which snap-in fingers 89 on lens 80 could fit. This would allow a separate optical lens 80 to be added for top mount light board 40T on housing 70. This could allow different manipulation of light from the LEDs on top board 40T than on side boards 40R, 40L. This could include filtering light for different color, dispersing it in a different manner, or diminishing the amount of light coming vertically up from that particular divider. It can also be patterned or coated so that light will scatter and/or reflect it more. It can be removable according to desire or need. Similarly, snap-on optical components could be possible for the other LEDs. An example of manipulation of light by lens 80 could be to diffuse it to disperse it in all directions from the LEDs of board 40T.

Another example of options or alternatives relate to the light sources themselves. One example would be that the light sources 48 could emit a selected color of light. This could be white, blue, red, or other colors. Different boards could have LEDs of different colors. Different LEDs on a single board could be of different colors.

Operation of colors from LED of different boards could be selectable. In other words, any of or all three boards 40T, 40R and 40L could come on when the refrigerator door is opened but each could then turn off at different times. Or, if one side of the shelf 20 held food of a different type than the other or had temperature settings that differ, different colors for different sides could be an option.

FIG. 16 gives one illustration of how a programmable controller 13 for appliance 10 might operate different color LEDs. FIG. 16 illustrates a lighting algorithm that could be executed by controller 13.

Algorithm 100 starts (reference numeral 101) with consumer selection from a user interface (e.g., a keypad or touchscreen either on the external side of appliance 10 or in the cabinet). There could also simply be a set of buttons, each one having a unique lighting scheme when selected.

As indicated in 102 in FIG. 16, in this example three options are presented to the consumer.

In step 103, the selected option is sent to the main control board or controller 13. Controller 13 checks the option relative to what was previously set (step 104). If the selected option was previously set it would continue (step 105). If not, it would be changed (106). Controller 13 would send instructions to the shelf divider lighting subassemblies 30 that are relevant to the user selection (step 107). The selected lighting scheme would be executed (step 108). The algorithm would then be complete (step 109) and wait for another loop through.

As can be appreciated, algorithm 101 is more aesthetic than functional as compared to using illumination to visualize an item. In this example, option 1 entitled "Quiet Mood" could present blue or cool (e.g., cooler color temperature) light at a lower intensity than normal and in steady state. Option 2 entitled "Celebrating Mood" could present red flashing or sequential on and off at high intensity. Option 3 could be considered "normal" and simply present white light at a medium intensity and steady state. Of course, any combination or variation is possible. Color and brightness can be selected for a particular mood and those options stored in the main control board memory of main controller 13 and/or the consumer can set or override any default settings. Programmable controller 13 could be programmed with such different options, receive the user input, and instruct the appropriate LEDs accordingly. Any of a number of different lighting effect variations are, of course, possible.

As can be appreciated, other options are possible regarding other aspects of the apparatus or how it is operated. Examples have been given in this description. Further options or variations obvious to those skilled in the art will be included within the invention.

What is claimed is:

1. A refrigerator storage assembly for an interior of or on a door of a refrigerator cabinet of a refrigerator comprising:

a. a generally horizontal supporting surface in the interior of the cabinet or in the door, the supporting surface having a perimeter and a top defining a volume of storage space above it, wherein the supporting surface comprises a part of a shelf, drawer, bin or basket in any of a fresh food compartment, freezer compartment, or door of the cabinet, and the supporting surface is moveable relative to the cabinet;

b. a generally vertical divider member for the supporting surface, the divider member having a wall with a thickness defined by opposite sides, a top at a height greater than the thickness, and a length elongated along a longitudinal axis, the divider member extending at, above, and across substantially all of and within the perimeter of the top of the supporting surface to physically separate and partition lateral portions of the supporting surface and at least part of the storage space above it and expose the opposite sides of the divider to the physically separated lateral portions of the supporting surface;

c. a light source sub-assembly mounted in, to or at the divider member comprising one or more light sources along at least part of the divider's length across the supporting surface and having a light output distribution pattern adapted to distribute light at and laterally to the physically separated lateral portions of the supporting surface; and d. an electrical connection from the light source sub-assembly adapted for operative connection to an electrical power source connection in the cabinet.

2. The refrigerator storage assembly of claim 1 wherein the supporting surface is at least partially comprised of glass which transmits at least a portion of light from the light source sub-assembly when the light source sub-assembly is operating.

3. The refrigerator storage assembly of claim 2 wherein the glass reflects a portion of light from the light source sub-assembly when the light source assembly is operating.

4. The refrigerator storage assembly of claim 1 wherein the divider is attached to the cabinet.

5. The refrigerator storage assembly of claim 4 wherein the supporting surface is moveable relative to the divider.

6. The refrigerator storage assembly of claim 4 wherein the supporting surface comprises a single member.

7. The refrigerator storage assembly of claim 4 wherein the supporting surface comprises two sections on the opposite sides of the divider.

8. The refrigerator storage assembly of claim 7 wherein at least one of the two sections of the supporting surface is independently moveable relative to the other section.

9. The refrigerator storage assembly of claim 4 where the electrical power source connection comprises a conductive wire from the cabinet.

10. The refrigerator storage assembly of claim 1 wherein the one or more light sources comprises a plurality of solid state lights.

11. The refrigerator storage assembly of claim 1 wherein the divider is mounted to the supporting surface.

12. The refrigerator storage assembly of claim 1 wherein the divider is moveable along the supporting surface.

13. The refrigerator storage assembly of claim 1 further comprising an optical component positioned on the light source sub-assembly to manipulate light output from at least some of the one or more light sources.

14. The refrigerator storage assembly of claim 13 wherein the optical component comprises one or more of a light guide, light pipe, lens, reflector, visor, or light absorbing surface.

15. The refrigerator storage assembly of claim 1 wherein the supporting surface is moveable relative to the cabinet to and from a home position, the electrical connection comprises an electrically conductive member moveable with the supporting surface, and the electrical power source connection comprises an electrically conductive member to which the electrical connection comes into electrically conductive contact when the supporting surface is in the home position.

16. The refrigerator storage assembly of claim 15 wherein the electrical connection of the light source comprises an electrically conductive finger extending beyond an edge of the supporting surface and adapted to pass through a closure member in an aperture in the refrigerator cabinet to the electrical power source connection, wherein when the supporting surface is moved to the home position relative the cabinet, the finger extends through the closure member and into electrical connection with a power source to turn at least one of the one or more of the light sources on, but when the supporting surface is moved away from the home position, electrical contact is lost and the at least one of the one or more light sources is turned off.

17. The refrigerator storage assembly of claim 1 wherein the one or more light sources comprises a plurality of LEDs mounted on a board or substrate in communication with a drive circuit connected to a controller.

18. The refrigerator storage assembly of claim 17 wherein the plurality of LEDs are arranged in one or more arrays, certain of the plurality of LEDs emitting different colors when activated.

19. The refrigerator storage assembly of claim 18 further comprising a lens over at least one of the one or more arrays to control the light output distribution pattern from the at least one of the one or more arrays.

20. A system for illumination of at least a part of an interior of or on a door of a refrigerated appliance comprising:

a. a storage space in the interior of or on the door of the refrigerated appliance defined by a liner, the liner positioned within a cabinet of the refrigerated appliance;

b. a supporting surface having a perimeter positioned in the storage space, wherein the supporting surface comprises a part of a shelf, drawer, bin or basket in any of a fresh food compartment, freezer compartment, or door of the cabinet, and the supporting surface is moveable relative to the cabinet;

c. a divider member having a length, width, and height positioned at, above, and across at least part of the supporting surface physically separating lateral portions of the supporting surface within the perimeter of the supporting surface; wherein the height of the divider member is greater than the width;

d. a light source subassembly in, on, or at the divider operatively connectable to an electrical power source to emit a light distribution output that illuminates at least a part of the storage space of at least one of the physically separated lateral portions of the supporting surface.

21. The system of claim 20 wherein the supporting surface is at least partially light transmissive such that the emitted light distribution output from the light source sub-assembly illuminates the storage space at and above the supporting surface as well as through and below the supporting surface.

22. The system of claim 20 wherein the light source subassembly comprises primary illumination for the storage space.

23. The system of claim 20 wherein the light source subassembly supplements another light source for illumination in the storage space.

24. The system of claim 20 further comprising a light pipe or guide positioned to receive light from the light source subassembly and transmit it to a position away from the light source subassembly.

25. A method of illumination of at least a portion of an interior of or on a door of a refrigerated appliance comprising:

a. positioning an illumination source on a divider member positioned at, above, and across and physically separating lateral portions of a supporting surface of a shelf, drawer, or bin, in the interior of or on the door of the refrigerated appliance, wherein the supporting surface comprises a part of a shelf, drawer, bin or basket in any of a fresh food compartment, freezer compartment, or door of a cabinet of the refrigerated appliance, and the supporting surface is moveable relative to the cabinet;

b. operating the illumination source to illuminate the lateral portions of the supporting surface.

26. The method of claim 25 wherein the illumination source comprises a plurality of colored, individually controllable light sources and selected of the light sources are operated at certain times.

27. The method of claim 26 wherein operation of the selected light sources is dependent upon user-selection through a user interface associated with the refrigerated appliance.

28. The method of claim 27 wherein the user selections are between a first color, a second color, and a third color, wherein the first, second and third colors are correlated to mood.

29. The method of claim 28 wherein the first color is correlated to a quiet mood, the second color is correlated to a celebrating mood, and the third color is correlated to another mood.

30. The method of claim 29 wherein the individual light sources are driven by a master controller associated with the refrigerated appliance.

* * * * *